US008186978B2

(12) United States Patent
Tinholt et al.

(10) Patent No.: US 8,186,978 B2
(45) Date of Patent: May 29, 2012

(54) PUMP WITH LINEAR ACTUATOR

(75) Inventors: Thomas H. Tinholt, Galesburg, MI (US); Jeffrey J. Elsesser, Kalamzaoo, MI (US)

(73) Assignee: Humphrey Products Company, Kalamazoo, MI (US)

( * ) Notice: Subject to any disclaimer, the term of this patent is extended or adjusted under 35 U.S.C. 154(b) by 728 days.

(21) Appl. No.: 11/871,380

(22) Filed: Oct. 12, 2007

(65) Prior Publication Data

US 2009/0226332 A1 Sep. 10, 2009

Related U.S. Application Data

(60) Provisional application No. 60/855,528, filed on Oct. 31, 2006.

(51) Int. Cl.
*F04B 39/10* (2006.01)
*F04B 53/10* (2006.01)

(52) U.S. Cl. ..... 417/571; 417/415

(58) Field of Classification Search ..... 417/417, 417/560, 415, 454, 566, 570, 567, 564, 571; 137/512.15

See application file for complete search history.

(56) References Cited

U.S. PATENT DOCUMENTS

| | | | | | |
|---|---|---|---|---|---|
| 2,064,750 | A * | 12/1936 | Hurst | 417/214 |
| 3,427,988 | A * | 2/1969 | Schmieman et al. | 417/569 |
| 3,666,382 | A * | 5/1972 | Rasmussen | 417/533 |
| 4,021,153 | A * | 5/1977 | Cloup | 417/443 |
| 4,376,618 | A * | 3/1983 | Toyoda et al. | 417/417 |
| 4,874,299 | A * | 10/1989 | Lopez et al. | 417/413.1 |
| 5,518,375 | A * | 5/1996 | Vandromme et al. | 417/413.1 |
| 5,848,881 | A * | 12/1998 | Frezza | 417/560 |
| 7,377,758 | B2 * | 5/2008 | Sallows et al. | 417/568 |

* cited by examiner

*Primary Examiner* — Devon C Kramer
*Assistant Examiner* — Peter J Bertheaud
(74) *Attorney, Agent, or Firm* — Gardner, Linn, Burkhart & Flory, LLP

(57) ABSTRACT

A pump includes a housing with a pumping chamber, first and second check valves, and an inlet and an outlet in fluid communication with the pumping chamber through the check valves. The housing also includes a linear actuator with a pumping element located in the pumping chamber wherein actuation of the linear actuator induces the pumping element to move between the first and second check valves between a first position wherein the pump element moves toward the first check valve and generates a positive pressure in the pumping chamber that maintains the first check valve closed and opens the second check valve to allow fluid to flow to the outlet, and a second position wherein the pumping element moves away from the first check valve and reduces the pressure in the pumping chamber to allow the first check valve to open and draw in fluid from the inlet.

18 Claims, 10 Drawing Sheets

PUMP WITH LINEAR ACTUATOR

CROSS-REFERENCE TO RELATED APPLICATION

This application claims priority from U.S. patent application Ser. No. 60/855,528, filed Oct. 31, 2006, entitled PUMP WITH LINEAR ACTUATOR, which is incorporated by reference herein in its entirety.

TECHNICAL FIELD AND BACKGROUND OF THE INVENTION

The present invention relates to a pump and, more particularly, to a miniature pump that is particularly suitable for battery or fuel cell applications and medical applications and other applications where the volume of the fluid being delivered is relatively small.

SUMMARY OF THE INVENTION

The present invention provides a miniature pump that can be used in a wide variety of applications, including medical applications, battery or fuel cell applications, such as a fuel cell for a computer.

In one form of the invention, a pump includes a housing with a pumping chamber, first and second check valves, and an inlet and an outlet in selective fluid communication with each other through the pumping chamber. The second check valve includes a lip seal. In addition, the housing includes a linear actuator that includes a pumping element that is positioned in the pumping chamber and which is moved between the two checks valves between two positions—one position in which the pumping element applies pressure in the pumping chamber, which opens the second check valve to allow the fluid in the pumping chamber to be pumped through the outlet and further apply pressure against the first check valve, which is located at the inlet side of the pumping chamber, to thereby close off fluid communication between the inlet and the pumping chamber, and a second position where the pumping element is moved away from the first check valve to create a vacuum in the pumping chamber and to allow the first check valve to open and therefore allow fluid to enter the pumping chamber from the inlet.

In one aspect, the linear actuator comprises an electrically operated solenoid. For example, the solenoid includes a stem and an armature mounted to the stem and an electromagnetic field generator, such as a coil, which extends around the armature. The pumping element is mounted or otherwise formed on the stem. When the electromagnetic field generator is energized and generates an electromagnetic field, the electromagnetic field urges the armature to move axially through the electromagnetic field generator and move the stem such that the pumping element is moved toward the first check valve and to increase pressure in the pumping chamber to close the first check valve.

In yet another aspect, each check valve is formed from a lip seal. For example, the lip seals may be formed from an elastomeric seal member with a pair of lips or may be formed from two elastomeric bodies, each with a lip seal. The first lip seal forms an inner annular lip, which forms the first check valve, which opens and closes communication between the inlet and the pumping chamber. The second lip seal forms the check valve between the pumping chamber and the outlet.

In another aspect, the solenoid includes a biasing member, such as a spring, which is mounted about the stem, to apply a biasing force to urge the pumping element to its second position away and spaced from the first check valve. As noted above, when the pumping element is moved away from the first check valve, the vacuum is generated in the pumping chamber which is then followed by the opening of the first check valve, which allows the fluid from the inlet to flow into the pumping chamber. When the electromagnetic field generator is powered and generates an electromagnetic field, a force is generated which is sufficient to overcome the biasing force and to urge the pumping element to move toward the first check valve, which increases the pressure in the pumping chamber to close the first check valve but open the second check to allow the fluid to flow to the outlet from the pumping chamber. When the electromagnetic field generator is de-energized, the biasing member then returns the pumping element to its second position which starts another pump cycle.

It can be appreciated from the foregoing that a pump is provided that can be configured as a miniature pump that has a wide variety of applications where relatively low flows are desired.

These and other objects, advantages, purposes, and features of the invention will become more apparent from the study of the following description taken in conjunction with the drawings.

DETAILED DESCRIPTION OF THE DRAWINGS

DESCRIPTION OF THE PREFERRED EMBODIMENTS

Figure 1:
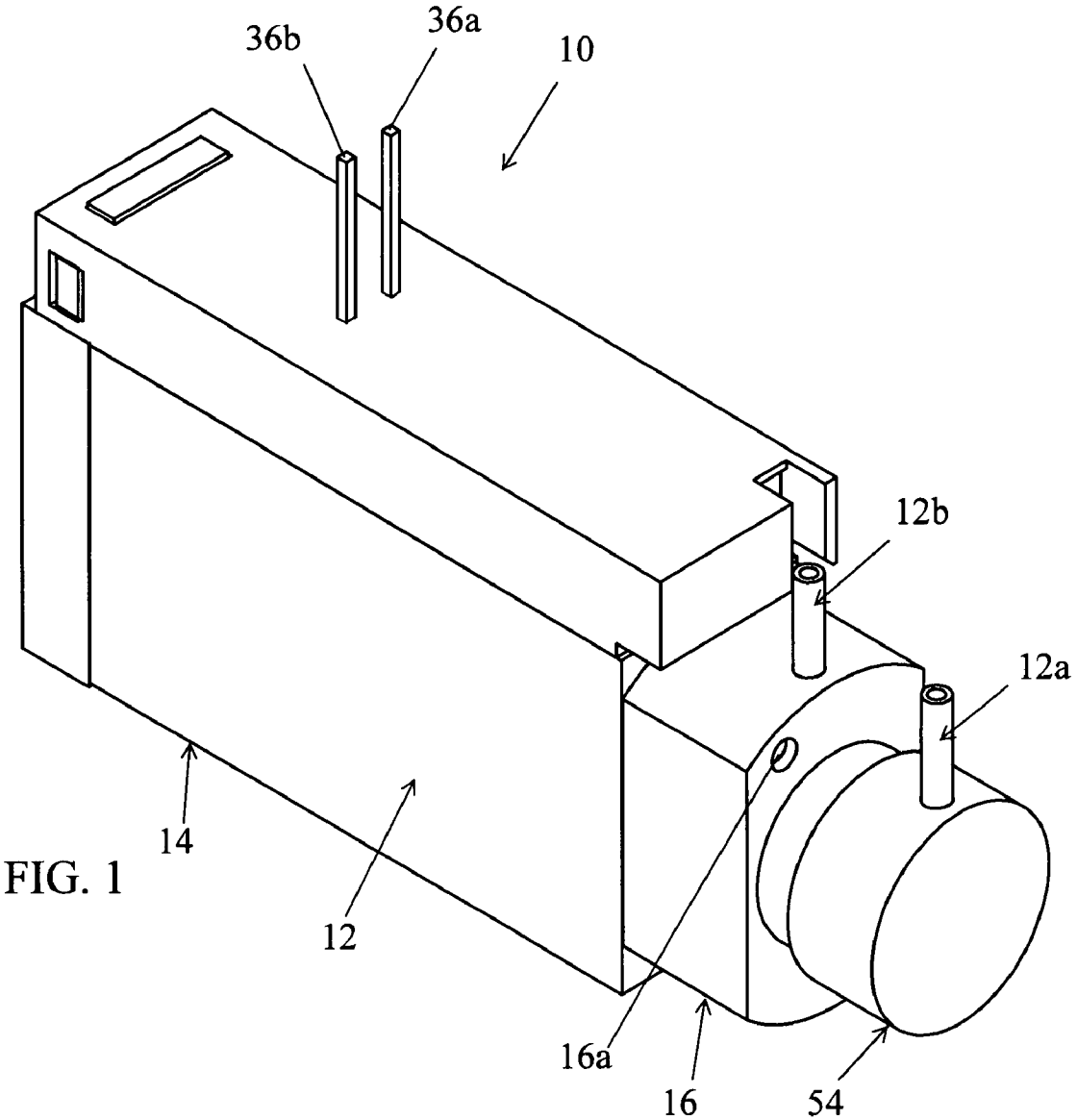
FIG. 1 is a perspective view of a solenoid pump of the present invention.

Referring to FIG. 1, the numeral 10 generally designates a pump of the present invention. Pump 10 comprises a miniature pump that incorporates one or more lip seal check valves, which is particularly suitable for battery operation, including fuel cells, and medical applications.

Figure 3:
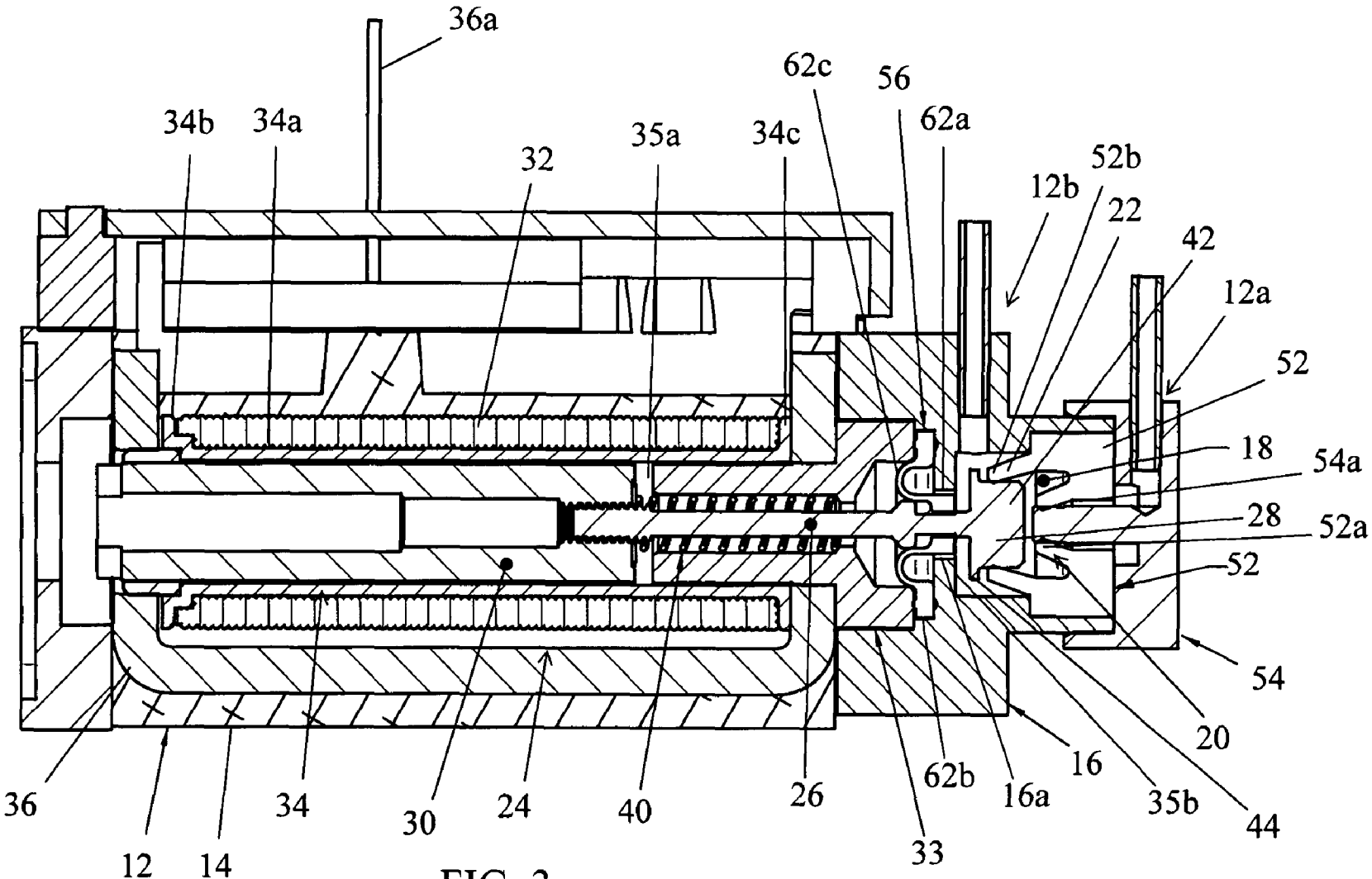
FIG. 3 is a cross-section taken along line III-III of FIG. 2.
Figure 4:
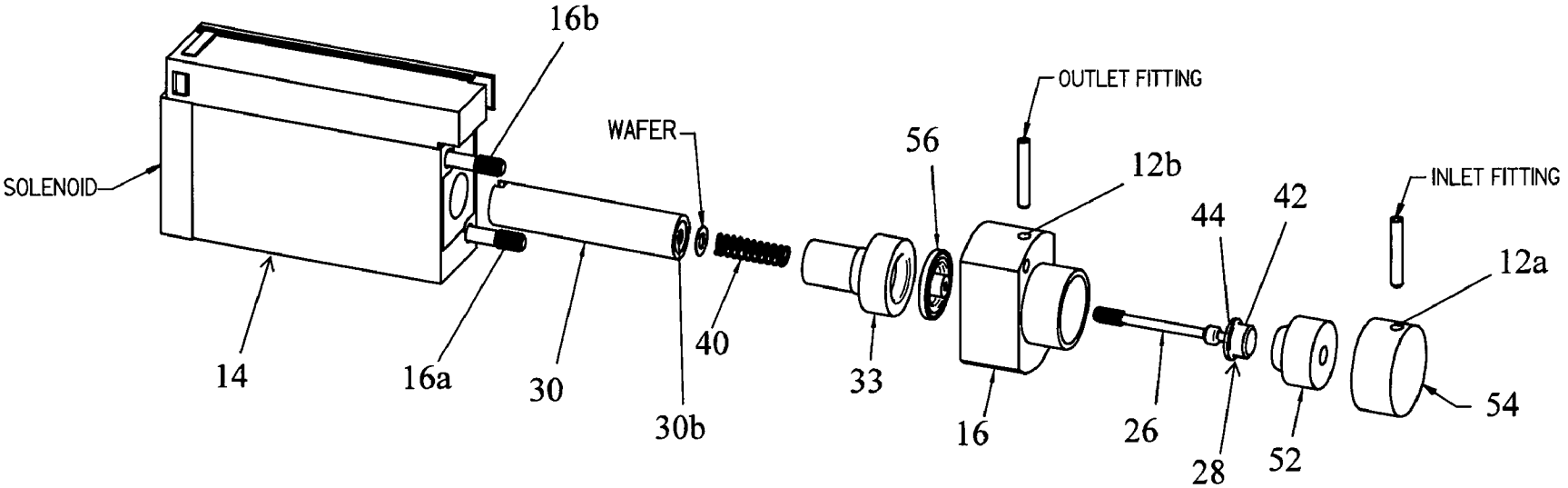
FIG. 4 is an exploded perspective view of the valve assembly of FIG. 1.

As best seen in FIGS. 3 and 4, pump 10 includes a housing 12, which in the illustrated embodiment is formed from an actuator housing 14 and a pump housing 16. Further, in the illustrated embodiment housings 14 and 16 are separate housings that are mounted together using conventional means, such as fasteners 16*a* and 16*b* (FIG. 4), or the like. Alternately, housings 14 and 16 may be formed as a unitary housing, and like the separate housings, may be formed from metal or a plastic material. Housing 12 includes a pumping chamber 18 and an inlet 12*a* and outlet 12*b*, which are in selective fluid communication with each other through pumping chamber 18. Pumping chamber 18 includes first and second check valves 20 and 22, which will be more fully described below.

Positioned in housing 14 is a linear actuator 24. In the illustrated embodiment, linear actuator 24 comprises a solenoid. However, it should be understood that other types of linear actuators may be used including a linear motor, a voice coil, or even a manual actuator. However, for ease of reference, the linear actuator will be described in reference to a solenoid application.

Figure 5:
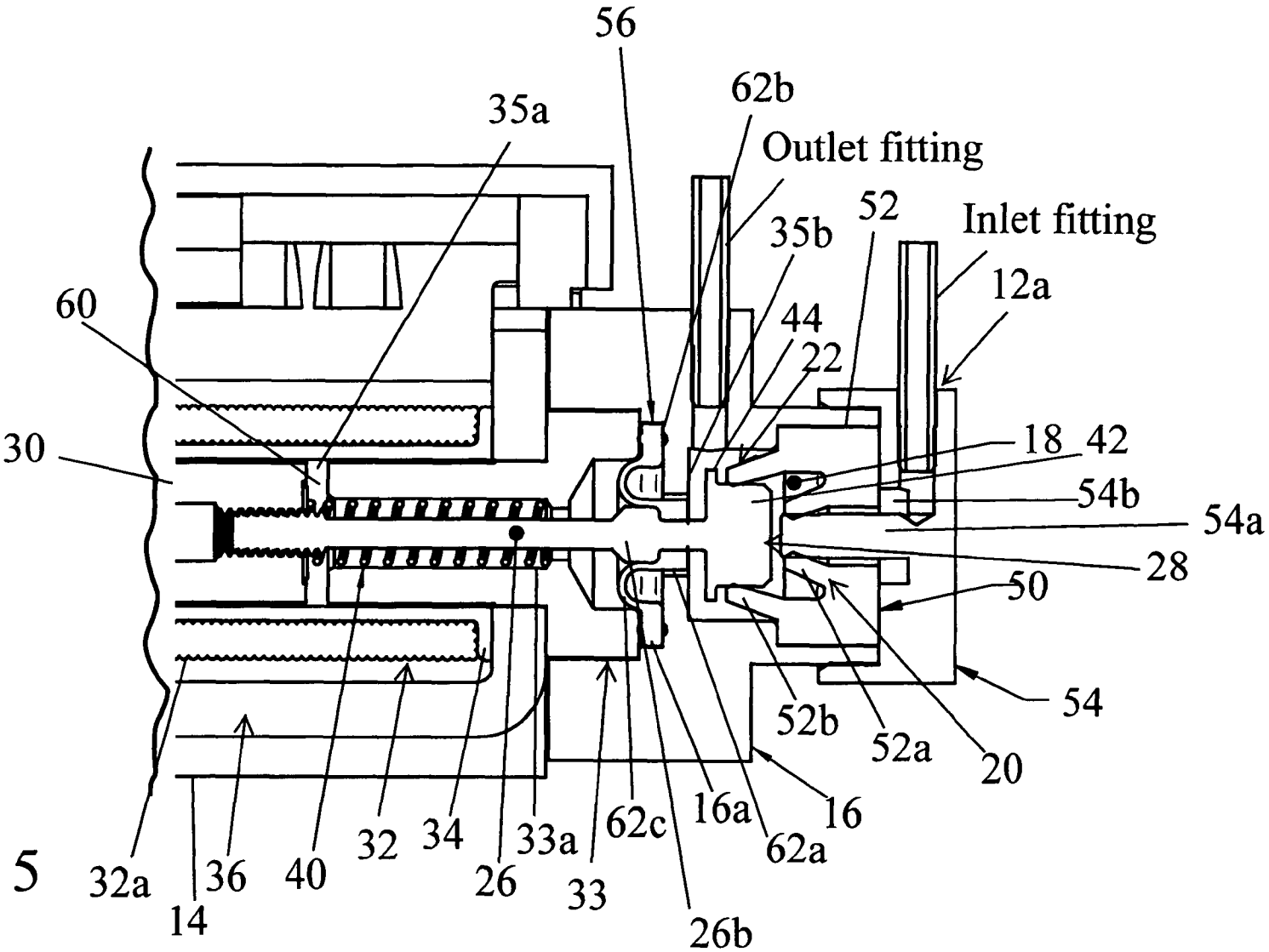
FIG. 5 is an enlarged partial cross-section of the pump housing.
Figure 6:
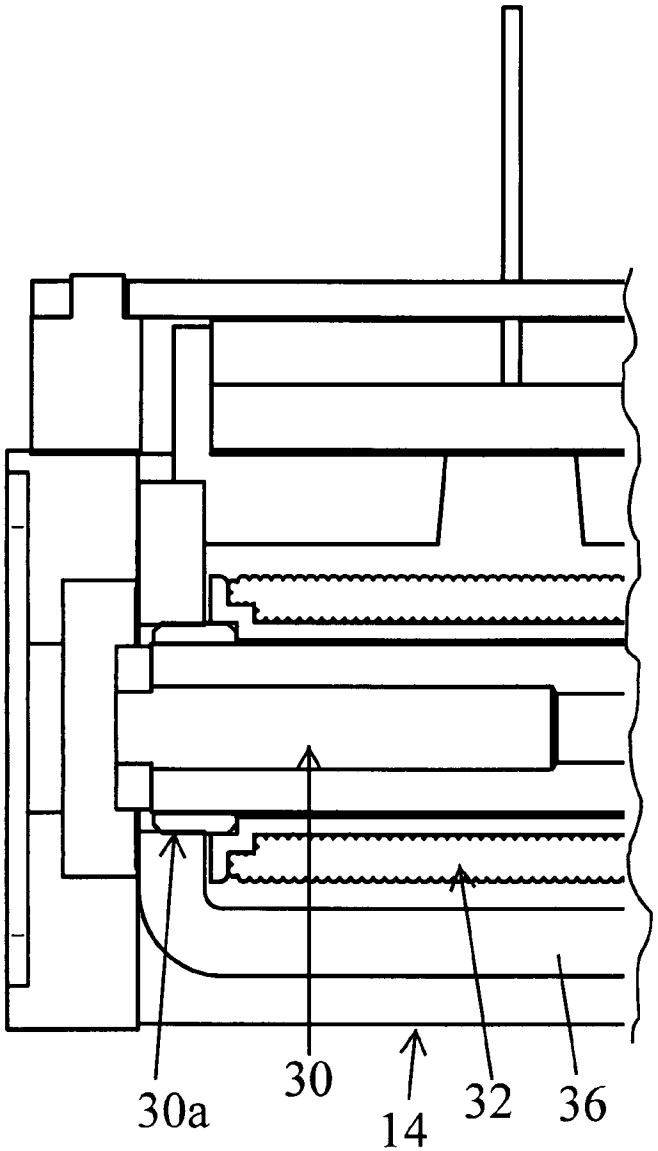
FIG. 6 is an enlarged partial cross-section of the solenoid housing.

As best seen in FIGS. 3 and 4, solenoid 24 includes a stem 26 with a pumping element 28, which is located in pumping chamber 18. Solenoid 24 also includes an armature 30, an electromagnetic field generator 32, and a center post 33. Armature 30 and center post 33 are formed from a magnetic material, such as low carbon steel. Center post 33, which extends into one end of housing 14 on one end and extends into housing 16 at its opposed end, provides a bridge or connector between the two housings and further provides a guide for stem 26 and for the biasing member noted below. In addition, the center post 33 provides a stop 35*a* (FIGS. 3 and 5) for the armature, as will be more fully described below. A stop 35*b* for the pumping element is provided by housing 16 (FIGS. 3 and 5).

Armature 30 is mounted to the end of stem 26 by a threaded connection, with center post 33 spaced from armature 30 by an air gap when the coil is de-energized. In order to increase the air gap when the coil is energized/actuated, the end of armature 30 includes a recessed portion 30*b*, which includes a removable plastic or other non-magnetic washer. The washer provides a stop or seat in the activated position. As would be understood, if the washer is removed the air gap is decreased.

In the illustrated embodiment, electromagnetic field generator 32 comprises a coil 32*a*, which is mounted about the armature 30 on a spool 34. Solenoid 24 operates in a conventional manner in that when a current is applied to coil 32*a*, coil 32*a* generates an electromagnetic field or a magnetic flux, which urges armature 30, and hence stem 26, to move axially through coil 32*a* and through passage 33*a* to close the air gap between the armature and the center post 33. Further, when stem 26 moves, pumping element 28, which in the illustrated embodiment is formed by an enlarged end of stem 26, moves through pumping chamber 18 to pump fluid from inlet 12*a* through pumping chamber 18 to outlet 12*b*, more fully described below.

Figure 2:
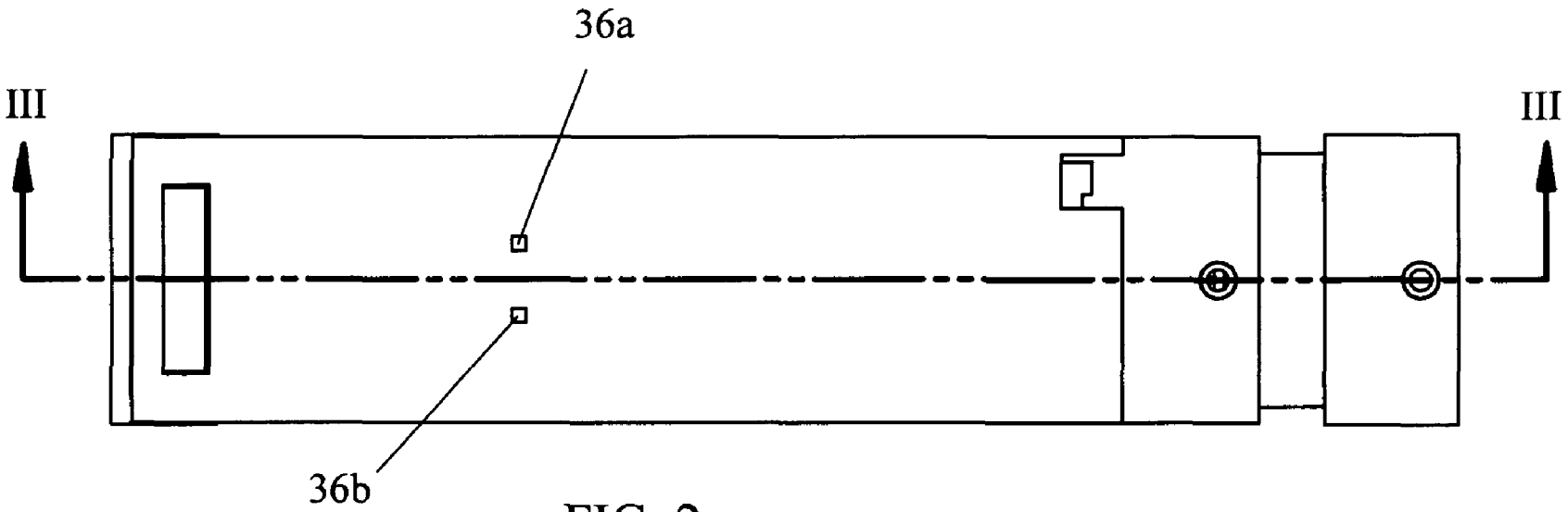
FIG. 2 is a top plan view of the pump of FIG. 1.

Spool 34 preferably comprises a non-magnetic bobbin, such as a glass filled plastic bobbin, and includes a sleeve portion 34*a* and upper and lower flanges 34*b* and 34*c*. Extending around sleeve portion 34*a* and captured between flanges 34*b* and 34*c* is a wire, which forms coil 32*a*. Spool 34 is supported in housing 12 by a frame 36, which is preferably a magnetic frame, such as a low carbon steel frame, and includes a pair of outwardly projecting conductive leads 36*a* and 36*b* (FIGS. 1, 2, and 3) which project through housing 12 (FIG. 2) for coupling to an external power supply. Coil 32*a* is coupled to conductive leads 36*a* and 36*b* and when energized controls the movement of stem 26 through housing 12 to control the movement of the pump element between the first and second check valves.

As noted, armature 30 comprises a magnetic material, such as nickel plated steel, and is piloted to frame 36 on one end by non-magnetic bushing 30*a* and mounted to stem 26 for limited axial movement in the passage formed in housing 12. Stem 26 extends through a central passage 33*a* of center post 33 to extend into pumping chamber 18 of pump housing 16 so that pump element 28 moves between a first position in which pump element 28 increases the pressure in pumping chamber 18, which applies pressure against check valve 20 to close fluid communication between inlet 12*a* and the pumping chamber, and a second position in which pump element 28 is moved away from first check valve 20 against housing 16 at stop 35*b*. When pumping element 28 is moved away from check valve 20, a vacuum pressure is generated in pumping chamber 18, which opens check valve 20 to allow fluid to flow into pumping chamber 18 from inlet 12*a*. When pump element 28 is then pushed back into pumping chamber 18, the pressure in the pumping chamber increases further and check valve 22 then opens to allow fluid to flow from pumping chamber 18 to outlet 12*b*.

In operation, therefore, when coil 32*a* is energized and current flows through coil 32*a*, coil 32*a* generates an electromagnetic field around armature 30 which urges armature 30 to the right as viewed in FIG. 3. The magnetic field between the armature and the center post will then urge pump element 28 toward the right and stop when armature 30 contacts stop 35*a*. As pump element 28 moves forward toward valve 20, the pressure in the pumping chamber 18 increases and is applied against valve 20 to thereby close valve 20, as noted above. The strength of the magnetic flux or the magnetic field depends on the wire size, the amount of current flowing, and the number of turns of the wire. As the number of turns or loops and current increases, so too does the magnetic flux.

When coil 32*a* is de-energized, however, stem 26 and armature 30 are returned by a biasing member 40, such as a spring, so that pump element 28 moves away from valve 20 until it contacts stop 35*b* which then generates the vacuum in the chamber to open fluid communication between the inlet and pumping chamber 18. In addition to providing a guide for stem 26, center post 33 also provides the bearing surface for spring 40, which extends into the open end of center post 33, and which is compressed when stem 26 is moved by the electromagnetic field to the right (as viewed in FIG. 3).

Referring again to FIGS. 3 and 4, pump element 28 includes a cylindrical body 42 and a flange 44, which together form the pumping element. As best seen in FIG. 3, check valve 20 is formed from a first sealing member 52*a*, and check valve 22 is formed from a second sealing member 52*b*. Sealing member 52*a*, 52*b* comprises lip seals formed from an elastomeric material. In the illustrated embodiment, lip seals 52*a*, 52*b* are formed on a unitary seal member 50. However, it should be understood that lip seals 52*a*, 52*b* may be formed as separate components that are in a juxtaposed position to provide the same or similar annular arrangement. Further, check valve 20 may be formed from another type of check valve, including a ball and seat check valve or a duck bill.

In the illustrated embodiment, seal member 50 includes an annular portion 52 with a pair of inwardly projecting flanges that form lip seals 52*a* and 52*b*, with lip seal 52*a* forming check valve 20 and lip seal 52*b* forming check valve 22. Seal member 50 is mounted in housing 16 on a cover 54, which includes inlet 12*a* and to which the inlet fixture is mounted. Further, cover 54 includes an inwardly projecting, stationary shaft or pin 54*a* about which seal member 50 is mounted, with lip seal 52*a* sealing against shaft 54*a*. Though lip seal 52*a* is shown sealing on a stationary shaft, it could also be mounted on a part of the stem as will be more fully described below in reference to FIG. 9.

Referring again to FIG. 5, lips 52*a* and 52*b* define therebetween the pumping chamber 18, which is in fluid communication with inlet 12*a* through a passage 54*b* and which is shut off from fluid communication with outlet 12*b* when the pumping element (28) is moved to its first position toward lip seal 52*a* where it increases the pressure in chamber 18.

To seal stem 26 in pump housing 16 an optional second sealing member 56 is provided on stem 26 adjacent stop 35*b*. Sealing member 56 is located in the passage 16*a* of pump housing 16 and provides a seal about stem 26 as well as a seal between center post 33 and housing 16.

Referring again to FIG. 3, sealing member 56 similarly comprises an annular seal member with a first cylindrical portion 62*a*, which is mounted about stem 26 adjacent an enlarged portion 26*a* of stem 26, which forms a stop for the sealing member. Sealing member 56 further includes a second cylindrical portion 62*b*, which provides a seal between center post 58 and pump housing 16. Cylindrical portions 62*a* and 62*b* are interconnected by a diaphragm 62*c* to thereby form a boot to accommodate the axial movement of stem 26 in housing 12.

Figure 7:
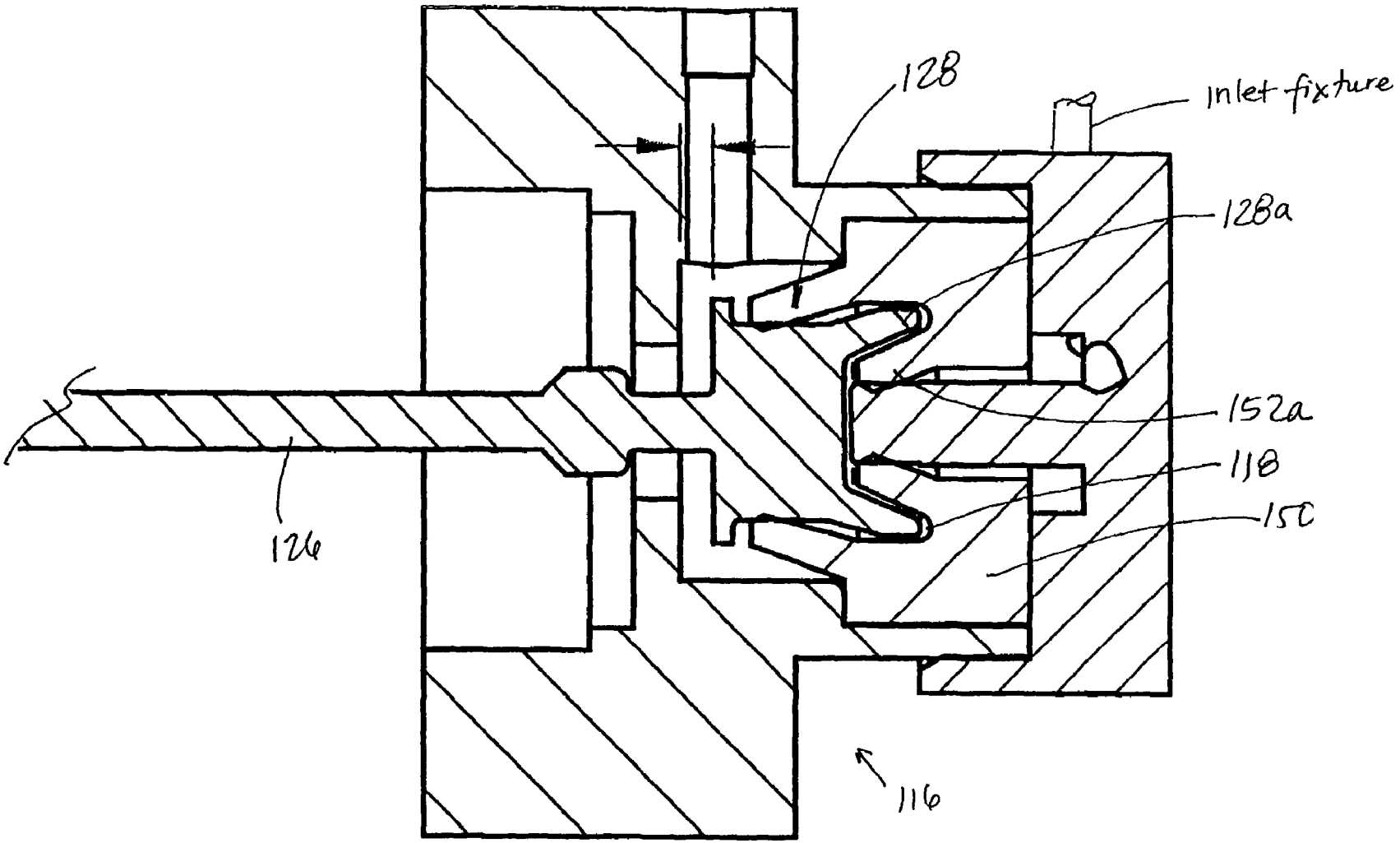
FIG. 7 is an enlarged view similar to FIG. 5 illustrating another embodiment of the pumping element shown in its first position applying pressure to the first check valve.
Figure 8:
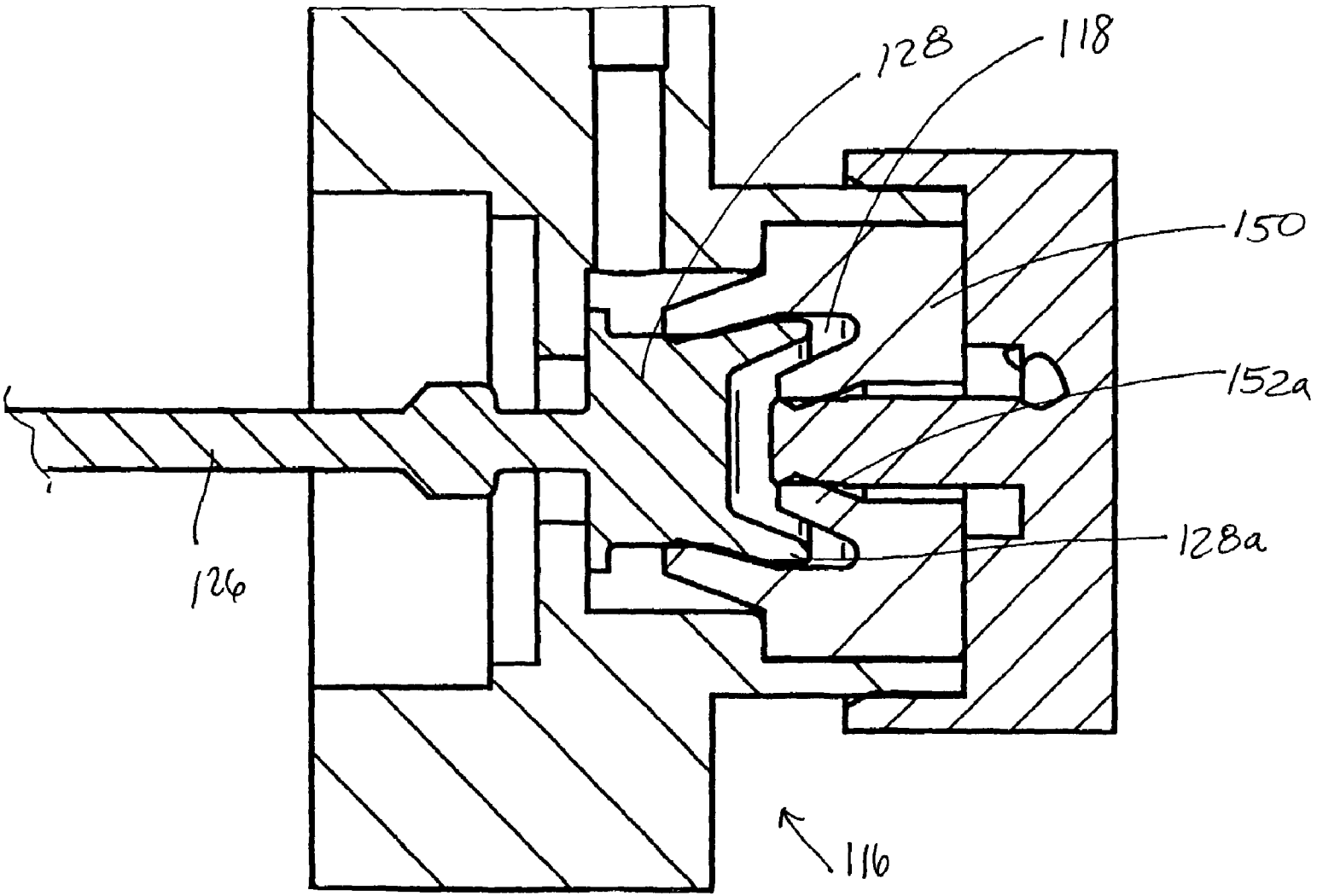
FIG. 8 is a view similar to FIG. 7 illustrating the pumping element in its second position moved away from the first check valve.

Referring to FIGS. 7 and 8, the numeral 128 designates another embodiment of the pumping element of the present invention. Pumping element 128 is of similar construction to pumping element 28 but includes an annular projection 128*a* at the side facing sealing member 150. Projection 128*a* projects into the pumping chamber 118 to reduce the volume of the pumping chamber, which facilitates self-priming of the pump. This results in an increased compression ratio and, subsequently, creates suction at the inlet. For further details of pump housing 116 and stem 126 and the linear actuator, reference is made to the first embodiment.

Figure 9:
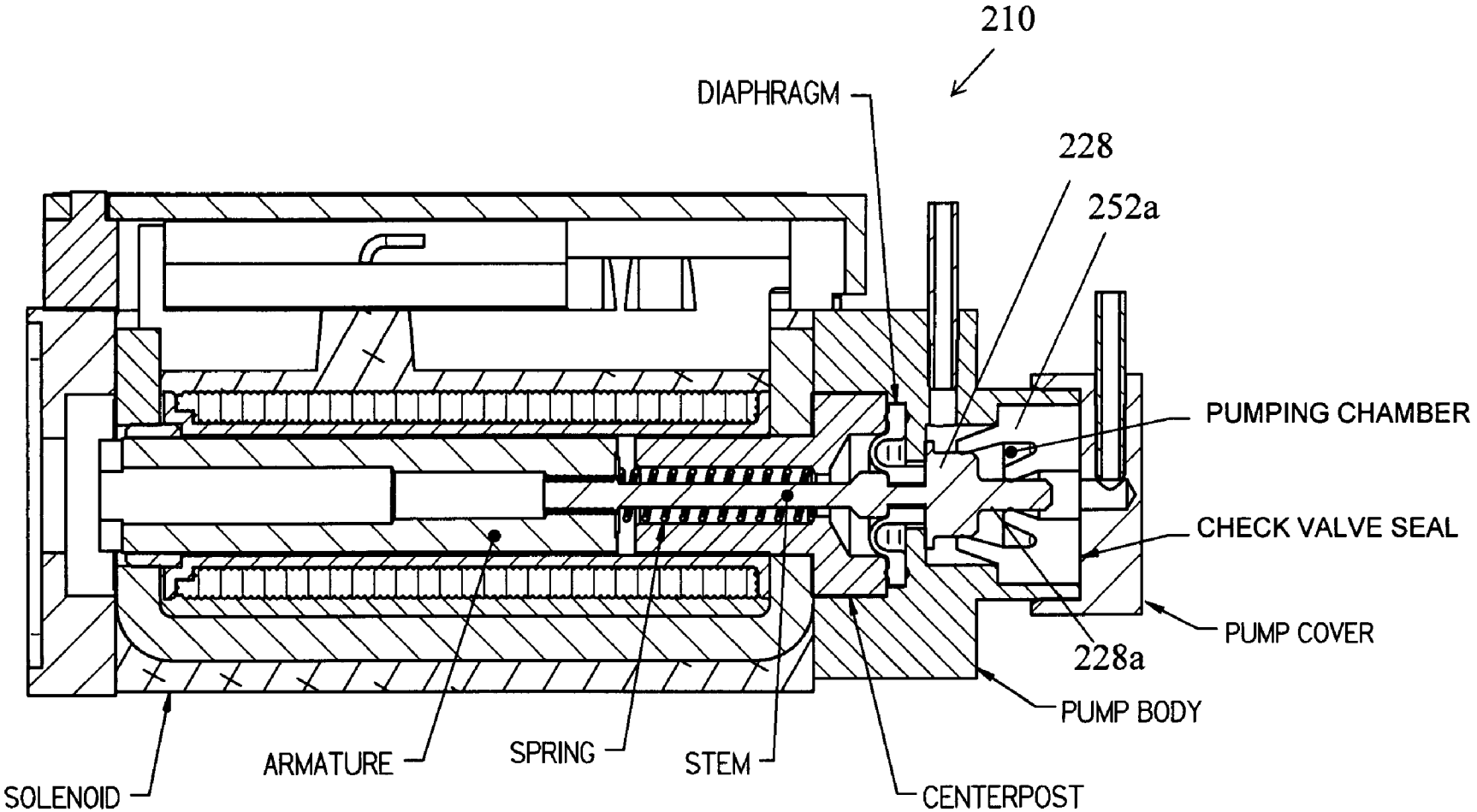
FIG. 9 is a similar view to FIG. 5 illustrating another embodiment of the stem with the first check valve sealing against the stem.
Figure 10:
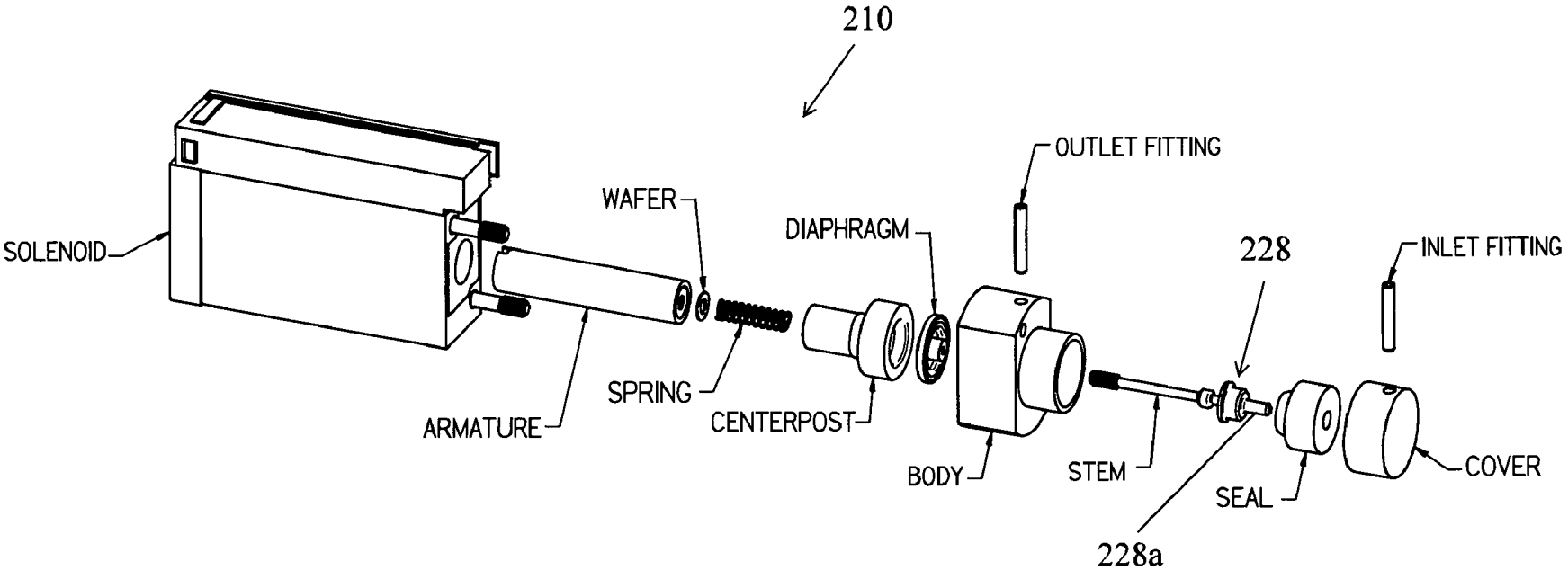
FIG. 10 is an exploded perspective view of the pump of FIG. 9.

As noted above, the sealing member may be mounted on the stem of the actuator. Referring to FIG. 9, pump 210 includes a pumping element 228 with an extended shaft 228*a* which extends through lip seal 252*a*. Pumping element 228 operates in a similar manner as pumping elements 28 and 128 described in reference to the previous embodiments; therefore, for further details of the solenoid and the operation of pumping element 228, reference is made to the previous embodiments.

As noted above, the housing for the pump may be formed from separate housing components, such as the solenoid housing and the pump housing described above, or may be formed from a unitary housing. In addition, the housing may be configured as a cartridge so that it may be simply plugged into a manifold. For example, the housing may include external annular seals as is commonly used in valve cartridges.

Accordingly, the pump of the present invention can be assembled as a miniature pump to consume less space than a conventional pump and further to consume less energy.

While several forms of the invention has been shown and described, modifications will be apparent to those skilled in the art. For example, a portion of the housing may be formed from a magnetic material to form the frame and center post. In this case the unitary frame and center post may include a slot to accommodate the wire termination for the coil. Further as noted, housings 14 and 16 may be formed as a unitary housing. Additionally, the pumping element and the lip seals may be varied to adjust the compression ratio of the pump. The embodiments described herein are only exemplary and not intended to limit the scope of the invention, which is, instead, defined by the claims that follow.

We claim:

1. A pump comprising:

first and second check valves aligned and spaced coaxially along a longitudinal axis and defining therebetween a pumping chamber;

an inlet and an outlet in fluid communication with said pumping chamber through said check valves;

a linear actuator having a stem and a pumping element coupled to said stem and located in said pumping chamber wherein actuation of said linear actuator induces said pumping element to move in said pumping chamber along said longitudinal axis between said first and second check valves and between (a) a first position wherein the pumping element moves toward said first check valve and generates a positive pressure in the pumping chamber with said positive pressure maintaining said first check valve closed and opening said second check valve to allow the fluid in said pumping chamber to flow to said outlet and (b) a second position wherein said pumping element and said stem move away from said first check valve and reduces the pressure in said pumping chamber to allow said first check valve to open and draw in fluid from said inlet into said pumping chamber to thereby pump fluid with said pump; and a unitary elastomeric body, said unitary elastomeric body forming both said first and second check valves such that said first and second check valves are formed on a single member.

2. The pump according to claim 1, wherein said linear actuator comprises a solenoid.

3. The pump according to claim 1, wherein each of said check valves comprises a lip seal.

4. The pump according to claim 1, wherein said linear actuator comprises a solenoid and wherein said solenoid further includes a spring to bias said stem to said second position.

5. The pump according to claim 4, wherein said solenoid includes a magnetic field generator and an armature mounted at said stem, when energized said magnetic field generator urging said armature to move said pumping element to said first position.

6. The pump according to claim 5, wherein said magnetic field generator comprises a coil.

7. A pump comprising:

a housing having a pumping chamber, first and second check valves aligned and spaced coaxially along a longitudinal axis, and an inlet and an outlet in fluid communication with said pumping chamber through said check valves, wherein said second check valve comprises a lip seal; and a linear actuator having a pumping element located in said pumping chamber wherein actuation of said linear actuator induces said pumping element to move in said pumping chamber linearly between said first and second check valves between a first position wherein the pumping element moves toward said first check valve and generates a positive pressure in the pumping chamber with said positive pressure maintaining said first check valve closed and opening said second check valve to allow the fluid in said pumping chamber to flow to said outlet, and a second position wherein said pumping element moves away from said first check valve and reduces the pressure in said pumping chamber to allow said first check valve to open and draw in fluid from said inlet into said pumping chamber to thereby pump fluid with said pump, wherein each of said check valves comprises a lip seal, wherein said lip seals are formed on a unitary seal member, further comprising a stationary shaft, said lip seal of said first check valve being mounted in said housing on said stationary shaft with said lip seal of said first check valve sealing against said stationary shaft when said pumping element moves toward said first check valve and opens relative to said stationary shaft when said pumping element moves away from said first check valve.

8. A pump comprising:

a housing having a pumping chamber, first and second check valves aligned and spaced coaxially along a longitudinal axis, and an inlet and an outlet in fluid communication with said pumping chamber through said check valves, wherein said second check valve comprises a lip seal; and a linear actuator having a pumping element located in said pumping chamber wherein actuation of said linear actuator induces said pumping element to move in said pumping chamber linearly between said first and second check valves between a first position wherein the pumping element moves toward said first check valve and generates a positive pressure in the pumping chamber with said positive pressure maintaining said first check valve closed and opening said second check valve to allow the fluid in said pumping chamber to flow to said outlet, and a second position wherein said pumping element moves away from said first check valve and reduces the pressure in said pumping chamber to allow said first check valve to open and draw in fluid from said inlet into said pumping chamber to thereby pump fluid with said pump, wherein each of said check valves comprises a lip seal, wherein said lip seals are formed on a unitary seal member, further comprising a stationary shaft, said lip seal of said first check valve being mounted in said housing on said stationary shaft with said lip seal of said first check valve sealing against said stationary shaft when said pumping element moves toward said first check valve and opens relative to said stationary shaft when said pumping element moves away from said first check valve, and wherein said housing includes a cover, said cover including said inlet.

9. A pump comprising:

a housing having a pumping chamber, first and second check valves aligned and spaced coaxially along a longitudinal axis, and an inlet and an outlet in fluid communication with said pumping chamber through said check valves, wherein said second check valve comprises a lip seal; and a linear actuator having a pumping element located in said pumping chamber wherein actuation of said linear actuator induces said pumping element to move in said pumping chamber linearly between said first and second check valves between a first position wherein the pumping element moves toward said first check valve and generates a positive pressure in the pumping chamber with said positive pressure maintaining said first check valve closed and opening said second check valve to allow the fluid in said pumping chamber to flow to said outlet, and a second position wherein said pumping element moves away from said first check valve and reduces the pressure in said pumping chamber to allow said first check valve to open and draw in fluid from said inlet into said pumping chamber to thereby pump fluid with said pump, wherein each of said check valves comprises a lip seal, wherein said lip seals are formed on a unitary seal member, further comprising a stationary shaft, said lip seal of said first check valve being mounted in said housing on said stationary shaft with said lip seal of said first check valve sealing against said stationary shaft when said pumping element moves toward said first check valve and opens relative to said stationary shaft when said pumping element moves away from said first check valve, and wherein said housing includes a cover, said cover including said inlet, wherein said cover includes said stationary shaft.

10. A pump comprising:

first and second check valves aligned and spaced coaxially along a longitudinal axis and defining a pumping chamber therebetween, and an inlet and an outlet in fluid communication with said pumping chamber through said first and second check valves, respectively, said first and second check valves being formed together from a single unitary body; and a solenoid having a magnetic field generator, an armature, and a pumping element coupled to said armature and located in said pumping chamber, when energized said magnetic field generator urging said armature to move said pumping element along said longitudinal axis in said pumping chamber between said first and second check valves and between (a) a first position wherein said pumping element moves toward said first check valve and generates a positive pressure in said pumping chamber with said positive pressure maintaining said first check valve closed and opening said second check valve to allow the fluid in said pumping chamber to flow to said outlet (b) and a second position wherein said pumping element moves away from said first check valve to define a gap between said pumping element and said first check valve and reduces the pressure in said pumping chamber to allow said first check valve to open and draw in fluid from said inlet into said pumping chamber to thereby pump fluid with said pump.

11. The pump according to claim 10, further comprising a stem, said pumping element coupled to said stem, and said stem coupled to said armature.

12. The pump according to claim 11, wherein said stem has an enlarged end, said enlarged end forming said pumping element.

13. The pump according to claim 10, further comprising a guide, said pumping element being guided by said guide.

14. The pump according to claim 13, further comprising a spring to bias said pumping element to said second position, said spring extending into said guide.

15. The pump according to claim 10, wherein said pumping element includes an annular projection facing said first check valve and extending into said pumping chamber, said projection reducing the volume of the pumping chamber.

16. The pump according to claim 10, wherein each of said check valves comprises a lip seal.

17. A method of pumping a fluid, said method comprising:

providing a pump housing with an inlet, an outlet, and a pumping chamber with first and second check valves, with the first and second check valves being formed together from a single unitary elastomeric body;

providing a pumping element in the pumping chamber;

coupling the pumping element to a linear actuator; and applying a force to the linear actuator to thereby move the pumping element through the second check valve toward and away from the first check valve to open and close the check valves and thereby pump fluid from the inlet to the outlet.

18. The method according to claim 17, wherein said applying a force includes generating a magnetic field, the magnetic field applying the force to the linear actuator.

* * * * *